US008166806B2

(12) United States Patent
Kappelmann et al.

(10) Patent No.: US 8,166,806 B2
(45) Date of Patent: May 1, 2012

(54) METHOD AND DEVICE FOR MONITORING A FUEL INJECTION SYSTEM

(75) Inventors: Peter Kappelmann, Stuttgart (DE); Dietrich Beckenbauer, Stuttgart (DE); Joachim Palmer, Korntal-Muenchingen (DE); Rene Zieher, Edingen-Neckarhausen (DE)

(73) Assignee: Robert Bosch GmbH, Stuttgart (DE)

( * ) Notice: Subject to any disclaimer, the term of this patent is extended or adjusted under 35 U.S.C. 154(b) by 142 days.

(21) Appl. No.: 12/305,167

(22) PCT Filed: Sep. 4, 2007

(86) PCT No.: PCT/EP2007/059212

§ 371 (c)(1),
(2), (4) Date: Nov. 13, 2009

(87) PCT Pub. No.: WO2008/040605

PCT Pub. Date: Apr. 10, 2008

(65) Prior Publication Data

US 2010/0050755 A1 Mar. 4, 2010

(30) Foreign Application Priority Data

Oct. 2, 2006 (DE) ..... 10 2006 046 840

(51) Int. Cl.
*G01M 15/04* (2006.01)

(52) U.S. Cl. ..... 73/114.45; 73/114.49

(58) Field of Classification Search ..... 73/114.45, 73/114.49

See application file for complete search history.

(56) References Cited

U.S. PATENT DOCUMENTS

| | | | | |
|---|---|---|---|---|
| 4,614,174 | A * | 9/1986 | Tanigawa et al. | 123/478 |
| 5,715,786 | A | 2/1998 | Seiberth | |
| 5,770,796 | A * | 6/1998 | Sakamoto et al. | 73/114.41 |
| 5,945,596 | A | 8/1999 | Burkel et al. | |
| 6,311,674 | B1 * | 11/2001 | Igashira et al. | 123/458 |
| 6,354,269 | B1 * | 3/2002 | Saito et al. | 123/436 |
| 6,502,551 | B2 * | 1/2003 | Antonioli et al. | 123/456 |
| 6,557,530 | B1 * | 5/2003 | Benson et al. | 123/480 |
| 6,564,616 | B2 * | 5/2003 | Antonioli et al. | 73/49.7 |
| 7,000,600 | B1 * | 2/2006 | Yamada et al. | 123/501 |
| 7,805,985 | B2 * | 10/2010 | Friedl et al. | 73/114.45 |
| 7,991,538 | B2 * | 8/2011 | Olbrich et al. | 701/104 |
| 2001/0025626 | A1 * | 10/2001 | Antonioli et al. | 123/456 |
| 2002/0112528 | A1 * | 8/2002 | Antonioli et al. | 73/49.7 |
| 2004/0118384 | A1 * | 6/2004 | Oyama et al. | 123/479 |
| 2006/0021598 | A1 | 2/2006 | Nomura | |

(Continued)

FOREIGN PATENT DOCUMENTS

| | | |
|---|---|---|
| DE | 19520300 | 12/1996 |

(Continued)

OTHER PUBLICATIONS

International Search Report, PCT International Patent Application No. PCT/EP2007/059212, dated Dec. 6, 2007.

*Primary Examiner* — Freddie Kirkland, III
(74) *Attorney, Agent, or Firm* — Kenyon & Kenyon LLP

(57) ABSTRACT

A method and a device for monitoring a fuel injection system are described. A manipulated variable is modified by a certain amount. A first value of a measured variable is detected prior to the modification and at least a second value is detected after the modification. An error is detected when the first value and/or the at least second value deviate from an expected value.

9 Claims, 3 Drawing Sheets

U.S. PATENT DOCUMENTS

2009/0164102 A1* 6/2009 Olbrich et al. ..... 701/103

FOREIGN PATENT DOCUMENTS

DE 195 48 279 4/1997
EP 0 795 076 9/1997
EP 1 088 980 4/2001
EP 1 205 657 5/2002
EP 1 408 221 4/2004

* cited by examiner

METHOD AND DEVICE FOR MONITORING A FUEL INJECTION SYSTEM

FIELD OF THE INVENTION

The present invention relates to a device and a method for monitoring a fuel injection system.

BACKGROUND INFORMATION

A method for detecting a leakage in a common rail system is described in German Patent Application No. DE 195 20 300. There, a control signal is applied to an actuator for influencing the rail pressure and it is checked whether the pressure changes as expected. If this is not the case, a leakage is detected.

SUMMARY

A device according to the present invention and a method according to the present invention may have the advantage over the related art in that they offer reliable and simple error detection in the area of fuel metering and are generally independent from the injection components used. This means that this approach is usable for common rail systems as well as for pump-nozzle systems and also for conventional distributor-type fuel injection pumps or in-line pumps. Moreover, the method and the device are usable in any injectors in common rail systems, i.e., in solenoid valve injectors and/or in piezoelectric actuators. Particularly advantageous is monitoring the control of the injection start or the injection position, since the related art only provides inadequate monitoring devices for this purpose.

Monitoring the injection start is advantageous because the injection start affects both the performance of the internal combustion engine and the consumption of the internal combustion engine. Furthermore, errors or tolerances in the injection start also affect the exhaust gas emissions.

In diesel internal combustion engines, the injection start is typically controlled in order to inject fuel into the cylinders at intended points in time and at intended piston positions. If errors or tolerances occur, i.e., injection takes place too early or too late, it is not detected in customary injection systems. Such defects may occur in the area of the control unit of the injection system, i.e., the injectors and/or the sensor elements which, for example, detect the injection start and/or the position of the internal combustion engine. Such modifications of the injection start may, among other things, result in a change in the emission behavior, the road performance, or the noise emission.

It may be particularly advantageous if only the change in the measured values between a first value and at least a second value is checked. It is preferably checked whether this change in the measured value is in an expected window, i.e., it is checked whether the change in the measured value is greater than a lower threshold value or smaller than an upper threshold value. If the change in the measured value is within the window, an error-free operation is detected, and if it is outside the window, an error is detected. Due to the analysis of the change based on a change in the manipulated variable, other error factors, which have an effect on the fuel injection, may be eliminated. This means that by influencing in a targeted manner the manipulated variable and a subsequent analysis of the change, which is caused by this modification of the manipulated variable, other error causes may reliably be ruled out and the error may be better allocated. In particular, the error may be allocated to the detection of the sensor signals, to the ascertainment of the manipulated variable in the control unit and/or to the actuator which carries out the injection. By ascertaining the relationships between the changes in the measured variable, a much better allocation than through analysis of the change is possible.

The engine speed or a variable such as the torque provided by the internal combustion engine is preferably used as the measured variable. It may also be provided that the angular acceleration or another variable, derived from the engine speed signal and/or an angle signal, is alternatively used as the measured variable. Furthermore, it is advantageous if the measured variable is determined from a structure-borne noise signal or a combustion chamber pressure signal.

BRIEF DESCRIPTION OF THE DRAWINGS

Exemplary embodiments of the present invention are represented in the figures and explained in greater detail below.

DETAILED DESCRIPTION OF EXAMPLE EMBODIMENTS

Figure 1:
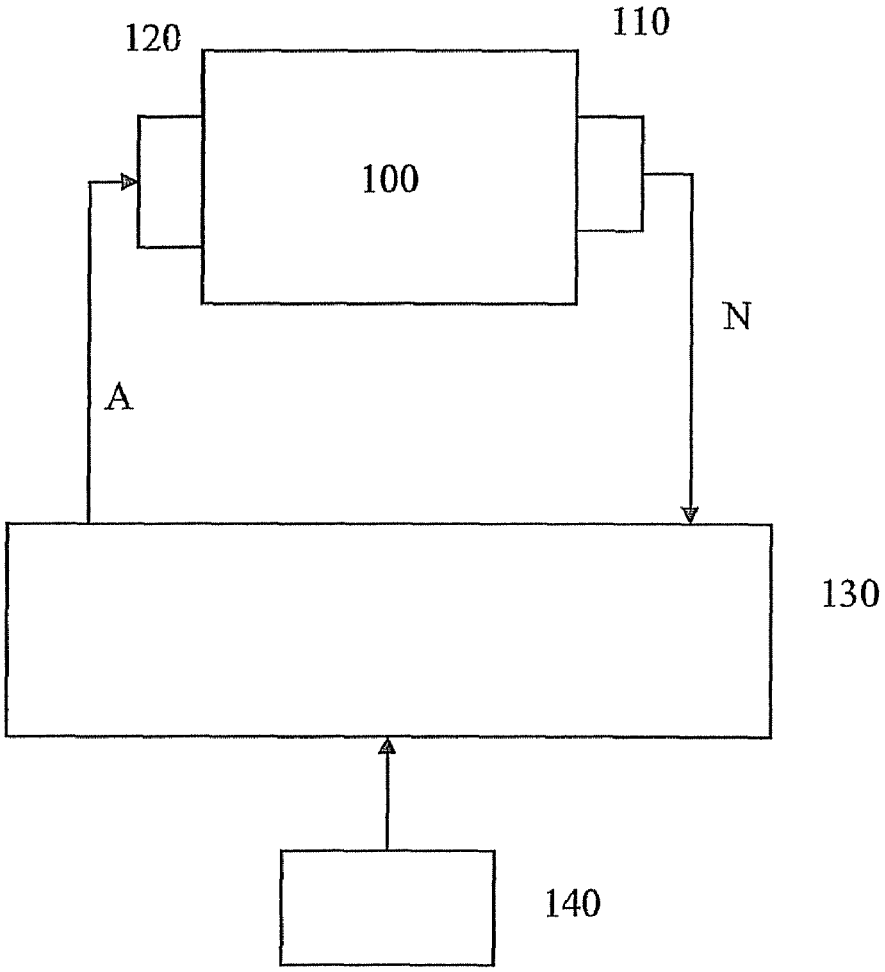
FIG. 1 shows a block diagram of the main elements.

FIG. 1 shows an example device according to the present invention as a block diagram. Reference numeral 100 indicates an internal combustion engine to which at least a first sensor 110 and an actuator 120 are assigned. Sensor 110 applies a signal N to a control unit 130 and control unit 130 in turn applies a control signal A to actuator 120. Moreover, control unit 130 processes the output signal of a second sensor 140. Internal combustion engine 100 shown is preferably a compression-ignition internal combustion engine. First sensor 110 detects a signal N which corresponds to the speed of the internal combustion engine. As a function of the specific embodiment of the approach according to the present invention, different variables may be determined based on the engine speed signal. The angular acceleration or other derivatives of the engine speed signal may be ascertained, for example, by using filters such as a differentiation, a band-pass filter, or a discrete Fourier transformation. These signals may be conveyed to control unit 130 instead of engine speed signal N.

As an alternative to this signal, other signals which characterize the torque provided by the internal combustion engine may also be detected. For example, a variable may be determined based on a structure-borne noise signal or a combustion chamber signal and used as a signal which characterizes the torque provided by the internal combustion engine. Furthermore, additional sensors may be provided which detect additional variables characterizing the operating state of the internal combustion engine. Such sensors are, for example, temperature sensors and/or pressure sensors which detect the temperature of the internal combustion engine, the pressure of the fuel and/or other variables.

Actuator 120 is preferably an injector which includes a solenoid valve or a piezoelectric actuator. Other actuators, which affect fuel-metering, may also be used instead of such an actuator. A pump-injector unit, a distribution pump, or an in-line pump may be provided in particular. At a certain point in time or at a certain position of the crankshaft of the internal combustion engine, the actuator meters a certain fuel quantity to the internal combustion engine as a function of the control signal provided by control unit 130. It is provided, for example, that the start of the current feed to the solenoid valve establishes the start of the injection and the end of the current feed establishes the end of the injection. Depending on the design of the controller or its actuator it may also be provided that the start of the current feed establishes the end of the metering process and the end of the current feed establishes the start of the metering process. The difference between the start of the current feed and the end of the current feed determines the period of the current feed or the metering period and thus the injected fuel quantity. Control unit 130 ascertains the control signal based on the signals of the first sensor and the second sensor 140.

Second sensor 140 detects variables in particular which characterize the vehicle's operating state or the surrounding conditions. The temperature and/or pressure variables are detected here in particular. Furthermore, it may be provided that the second sensor or the first sensor detects variables which characterize the exhaust system of the internal combustion engine. These variables are, for example, the temperature or the pressure in the exhaust gas or in the fresh air taken in.

Control unit 130 ascertains control signal A for actuator 120 based on the different variables. It may be the case that only one control step is provided in which one manipulated variable is predefined based on the input variables. Furthermore, a regulation may be provided which regulates, for example, the control start or another variable characterizing same, such as the injection start, the combustion start, or other variables, i.e., compares them with a setpoint value and, as a function of the difference between the setpoint value and the actual value, modifies them appropriately until the setpoint value matches the actual value.

It has been found according to the present invention that fuel metering has a major influence on the exhaust gas emissions. Moreover, errors in the entire system, i.e., in the actuator, in the internal combustion engine, in sensors 110, or in control unit 130 have effects on fuel metering. This means that, in the event of an error, the intended fuel quantity is not metered at the intended point in time. This in turn affects the behavior of the internal combustion engine, i.e., higher fuel consumption and/or increased exhaust gas emissions occur. Both must be reliably detected and avoided.

Figure 2:
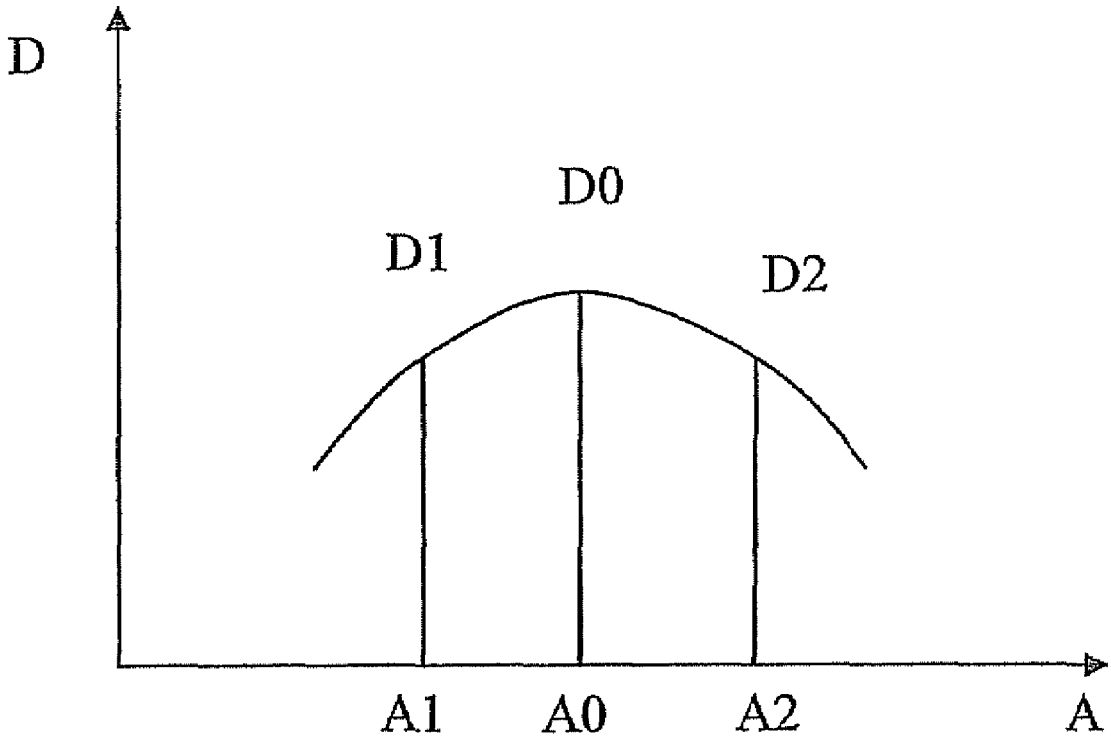
FIG. 2 shows different signals plotted against the injection start.

The connection between measured values M and measured value changes D is plotted in FIG. 2 for three different injection starts A. These measured values M are preferably ascertained from the increase in engine speed. For example, an angular acceleration may be used as the measured value which is formed by differentiation of the engine speed signal. As an alternative to the angular acceleration, the result of another filtering method on the engine speed signal, such as band-pass filtering or a discrete Fourier transformation, may also be used.

Reference numeral A0 indicates the initial value for the control start. This value is usually used in the present operating states for controlling the actuator element. Furthermore, a first control value A1 and a second value A2 are plotted for the control start in which initial value A0 is reduced by a small value or increased by a small value. Measured value change D1 corresponds to the quotient of measured value M between the state with control start A0 and control start A1. Correspondingly, value D2 indicates the quotient of the measured values between the operating point with control value A0 and control start A2. Value D0 assumes value 1 since this indicates the quotient between control start A0 and control start A0.

Figure 3:
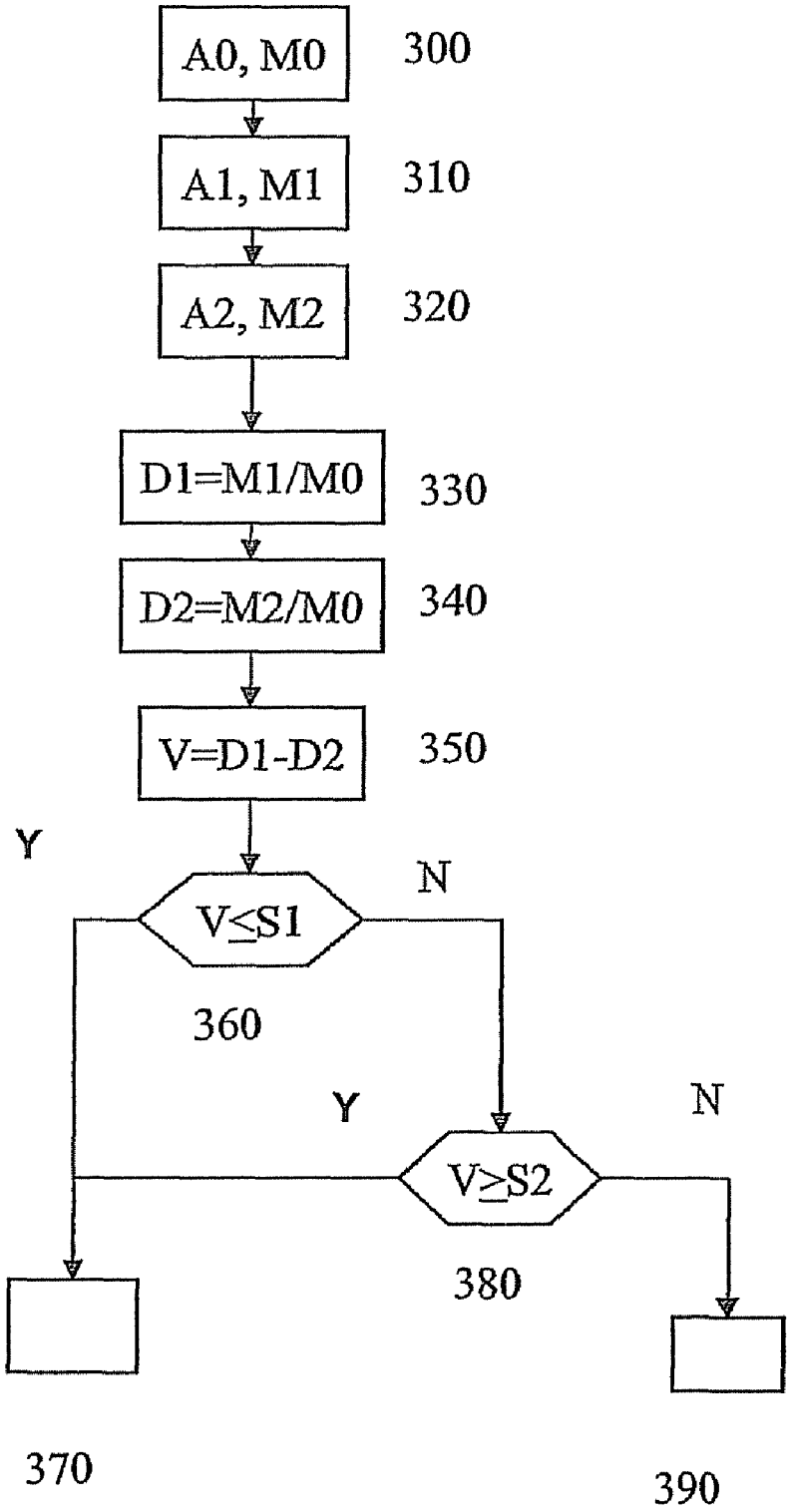
FIG. 3 shows a flow chart of the method according to the present invention.

As shown in FIG. 3, it is provided according to the present invention that in a first step 300 the control signal with control start A0, which is typical in the operating state, is output and measured value M0 is detected. In step 310, the control start is modified to value A1 and measured value M1 is detected. Correspondingly in step 320, the value for the control start is set to value A2 and measured value M2 is ascertained. The engine speed or variables derived from the engine speed is/are preferably used as the measured values. As an alternative to the engine speed, other variables which characterize the torque provided by the internal combustion engine may also be analyzed.

In subsequent step 330, quotient D1, i.e., the quotient between measured value M1 and measured value M0, is ascertained. Quotient D2, i.e., the quotient between measured value M2 and M0, is calculated in step 340. Difference V between the two quotients D1 and D2 is ascertained in step 350. The subsequent query 360 checks whether difference V is smaller than a first threshold value S1. If this is the case, then the program is terminated in step 370 with an error detection. If query 360 recognizes that difference V is not smaller than threshold value S1 then query 380 ensues. This query checks whether difference V is greater than or equal to second threshold value S2. If this is the case, step 370 also detects an error. If this is not the case, step 390 detects an error-free state.

This means that it is checked in this exemplary embodiment whether the difference of the quotients of the measured values, ascertained from the engine speed, are in a certain measuring window which is defined by values S1 and S2, S1 being smaller than S2. If this is the case, i.e., the measured values for difference V are in this window, an error-free operating state is detected, and otherwise an erroneous operating state is detected.

It may also be provided according to the present invention that additional measuring points are defined, i.e., that the control start is modified by additional small amounts or by an amount between A0 and A1 or between A0 and A2 and the corresponding differences are calculated and appropriately analyzed.

This means that the engine speed changes of different injection starts are analyzed. If these measured values do not match the values established in the application, then an error is detected. Preferably analyzed are not the engine speed values but rather the engine speed changes between the typical control start and the modified control start. It is particularly advantageous when instead of the engine speed changes the ratios of the engine speed changes are analyzed.

It may also be provided in one embodiment that multiple ratios are formed and also compared to threshold values. This means that it is checked whether a change in the control start results in an expected change in the engine speed or in another measured variable. It is particularly advantageous that, instead of the engine speed, a variable is analyzed which characterizes the torque provided by the internal combustion engine.

What is claimed is:

1. A method for monitoring a fuel injection system, comprising:

modifying a manipulated variable by a certain amount;

detecting, with a sensor, a first value of a measured variable prior to the modifying, and detecting, with the sensor, at least a second value after the modifying;

detecting an error when at least one of the first value and the at least second value deviate from an expected value; and ascertaining a difference of at least two modifications of the measured variable, and comparing the difference to an expected value, and in the event of a deviation, detecting an error;

wherein an error is detected when the modification of the measured value between the first value and the at least second value is not in an expected window.

2. The method as recited in claim 1, wherein the manipulated variable is a variable which influences the injection start.

3. The method as recited in claim 1, wherein the measured variable is an engine speed or a variable which characterizes a torque provided by an internal combustion engine.

4. A device for monitoring a fuel injection system, comprising:

an arrangement adapted to modify a manipulated variable by a certain amount, and adapted to detect a first value of a measured variable prior to the modification and at least a second value after the modification, the arrangement adapted to detect an error when at least one of the first value and the at least second value deviate from an expected value and to ascertain a difference of at least two modifications of the measured variable, compare the difference to an expected value, and in the event of a deviation, detect an error;

wherein an error is detected when the modification of the measured value between the first value and the at least second value is not in an expected window.

5. The device as recited in claim 4, wherein the measured variable is an engine speed or a variable which characterizes a torque provided by an internal combustion engine.

6. A device for monitoring a fuel injection system, comprising:

a modifying arrangement to modify a manipulated variable by a certain amount; and a detecting arrangement to detect a first value of a measured variable prior to the modification and at least a second value after the modification, wherein the detecting arrangement is configured to detect an error when at least one of the first value and the at least second value deviate from an expected value and to ascertain a difference of at least two modifications of the measured variable, compare the difference to an expected value, and in the event of a deviation, detect an error;

wherein an error is detected when the modification of the measured value between the first value and the at least second value is not in an expected window.

7. The device as recited in claim 6, wherein the manipulated variable is a variable which influences the injection start.

8. The device as recited in claim 6, wherein the measured variable is an engine speed or a variable which characterizes a torque provided by an internal combustion engine.

9. The device as recited in claim 4, wherein the manipulated variable is a variable which influences the injection start.

* * * * *